United States Patent [19]

Clem

[11] 3,949,560

[45] Apr. 13, 1976

[54] METHOD AND COMPOSITION FOR PREVENTING WATER CONTAMINATED WITH INDUSTRIAL WASTE FROM SEEPING THROUGH SOIL CONTAINING SAID WATER

[75] Inventor: Arthur G. Clem, Des Plaines, Ill.

[73] Assignee: American Colloid Company, Skokie, Ill.

[22] Filed: May 23, 1974

[21] Appl. No.: 472,668

Related U.S. Application Data

[63] Continuation-in-part of Ser. No. 330,200, Feb. 7, 1973, abandoned.

[52] U.S. Cl. ..... 61/36 R

[51] Int. Cl.[2] ..... E02D 3/12

[58] Field of Search ..... 61/1 R, 36, 35; 210/58; 175/72; 166/305 D

[56] References Cited

UNITED STATES PATENTS

| | | | |
|---|---|---|---|
| 2,205,950 | 6/1940 | Flett | 71/64 SC |
| 2,393,173 | 1/1946 | Larsen | 61/36 R |
| 3,016,713 | 1/1962 | Deming | 61/1 R |
| 3,111,006 | 11/1963 | Caron | 61/36 R |
| 3,630,937 | 12/1971 | Baum et al. | 210/58 |
| 3,772,893 | 11/1973 | Eilers | 61/36 R |
| 3,774,402 | 11/1973 | Muzychencko et al. | 61/36 R |

*Primary Examiner*—Dennis L. Taylor
*Attorney, Agent, or Firm*—Poms, Smith, Lande & Glenny

[57] ABSTRACT

There is disclosed a method for containing water having a high concentration of water-soluble industrial waste which, when in contact with bentonite, disintegrates the bentonite thereby allowing seepage of water through soil containing said water which comprises intimately admixing with said soil a soil sealant composition consisting essentially of bentonite, a water-soluble dispersing agent, and a water-soluble polymer selected from the group consisting of polyacrylic acid, water-soluble salts of polyacrylic acid, hydrolyzed polyacrylonitrile, polyvinyl acetate, polyvinyl alcohol, copolymers of the foregoing, and a copolymer of acrylic acid and maleic anhydride, the amount of water-soluble polymer being from 0.1% to 3.0%, by weight, and the amount of water-soluble dispersent being from 0.1% to 3.0%, by weight, the weight ratio of water-soluble dispersent to water-soluble polymer being from 6:1-36, intimately admixing an effective amount of said soil sealant composition with soil, forming a water-containing enclosure from said mixture of soil sealant composition and soil, and contacting said enclosure with water containing substantially no industrial waste compounds thereby hydrating the bentonite.

10 Claims, No Drawings

METHOD AND COMPOSITION FOR PREVENTING WATER CONTAMINATED WITH INDUSTRIAL WASTE FROM SEEPING THROUGH SOIL CONTAINING SAID WATER

CROSS-REFERENCE TO RELATED APPLICATIONS

This application is a continuation-in-part of my copending application Ser. No. 330,200, filed on Feb. 7, 1973, which is now abandoned.

BACKGROUND OF THE INVENTION

In recent years, pollution has become an increasing problem facing all nations of the world. Among those pollution problems which have increased the most is the problem of water pollution and what to do with the contaminated water.

Heretofore, lagoons and various other water holding areas formed from soil have been used extensively for pollution control and, in order to prevent seepage of the water contained in said water-holding areas, bentonite has been admixed with the soil forming the water-holding areas. Bentonite is normally effective because it swells when in contact with water thereby filling up the voids found in soil. Thus, bentonite, has been a satisfactory solution for containing water which had not been highly contaminated with water-soluble industrial waste; however, when the water is contaminated with such industrial waste the use of bentonite has not per se prevented seepage of water through the soil because most industrial waste will cause the bentonite to disintegrate.

In order to prevent seepage of water contaminated with relatively small amounts of said industrial waste (in the case of calcium chloride as little as 2.3%) it has been proposed to prehydrate the bentonite prior to contact of the contaminated water. This has been relatively satisfactory with water containing very small amounts of such water-soluble industrial waste material but when the water contains any significant amounts of calcium chloride (and more than 4% sodium chloride) seepage still occurs.

Inasmuch as a rather large amount of water contains water-soluble industrial waste compounds it is readily apparent that it is a desideratum in the art to find a method for confining water which is highly contaminated with such water-soluble industrial waste compounds.

SUMMARY OF THE INVENTION

This invention is predicated on the surprising discovery that a composition when added to soil will prevent seepage of water therethrough when the water contains large amounts of water-soluble industrial waste inorganic salts such as the water-soluble chloride salts, water-soluble sulfite salts and water-soluble sulfate salts.

Accordingly, one of the principal objects of the present invention is to disclose and provide a method for forming lagoons and other water-holding areas which will not allow seepage therethrough of water containing inorganic water-soluble industrial waste compounds.

Another object of the present invention is to disclose and provide a composition, which when added to soil, will prevent seepage through the soil of water contaminated with water-soluble industrial waste compounds.

A further object of the present invention is to disclose and provide a soil containing an additive which is useful in forming lagoons and water-holding areas which will not allow seepage therethrough of water containing large amounts of water-soluble industrial waste compounds.

Still another object of the present invention is to disclose and provide a soil sealant composition containing, as essential ingredients, bentonite, a certain type of water-soluble dispersent, and a certain type of water-soluble polymer.

Still a further object of the present invention is to disclose and provide a method of forming water holding areas made of soil, said water-holding areas being capable of holding water contaminated with water-soluble industrial waste compounds without seepage through the soil, said method including the step of forming a mixture of soil and a soil sealant composition composed of bentonite, a water-soluble dispersing agent, and a water-soluble polymer, forming a water containing enclosure from said soil, and hydrating the bentonite contained in the soil by contacting same with water substantially uncontaminated with water-soluble industrial waste compounds.

Still another and further object of the present invention is to disclose a novel method of treating bentonite so that it will not disintegrate when contacted with water containing water-soluble industrial waste compounds such as inorganic water-soluble chloride salts, sulfate salts and sulfite salts.

Other objects of the present invention will be apparent from the following detailed description in which all parts and percentages are by weight unless specifically indicated otherwise.

DESCRIPTION OF THE PREFERRED EMBODIMENT

As noted above, the invention herein relates to a composition containing bentonite, a water-soluble dispersent, and a water-soluble polymer, said composition being useful in preventing leaking of water holding areas for contaminated water which are formed of soil.

It should be noted that when the specification and claims refer to "soil" this term includes sand, clay, sandy soil, topsoil, etc. It is of no moment what type of soil is utilized in the present invention since the soil sealant composition disclosed herein will swell and fill the voids contained in the most porous of soils, e.g. silica sand of large particle size.

The bentonite utilized in the present invention is one which will hydrate in the presence of water, i.e., will swell in the presence of water. A preferred bentonite is sodium bentonite which is basically a hydratable montmorillonite clay which has a sodium as its predominate exchangeable ion. However, the bentonite utilized in the present invention may also contain other cations such as magnesium and iron. The particular cation contained in the bentonite is not important, what is important is the replaceable or exchangeable cation. As noted above, the sodium bentonite will swell in water and is therefore the type of bentonite which is most useful in the present invention.

In order to prevent the bentonite from preventing leakage of water contaminated with water-soluble industrial salts such as sodium chloride or calcium chloride it is absolutely necessary that the soil sealant composition include a certain type of water-soluble dispersent and a water-soluble polymer.

The water-soluble dispersent can be a water-soluble salt of phosphoric acid (a phosphate) such as hypophosphate, orthophosphate, metaphosphate, and pyrophosphate. The particular cation forming the salt is not important providing that the resulting salt is water-soluble. For example, the cation can be almost any metal such as an alkaline metal or an alkaline earth metal. Exemplary of the alkaline metal salts are sodium orthophosphate, trisodium orthophosphate, sodium metaphosphate, and sodium pyrophosphate. Other alkaline metals which are useful in producing phosphate salts which may be utilized in the present invention are potassium orthophosphate, potassium hydrophosphate, potassium pyrophosphate, and lithium phosphate. As examples of alkali earth metals there may be mentioned monocalcium phosphate.

As noted above, the water-soluble phosphoric acid salts are excellent dispersents; however, other water-soluble dispersents can also be used.

For example, there may be mentioned water-soluble sulfates having a hydrophobic group attached to the sulfate group, such compounds having the formula $ROSO_3X$, where R is any hydrocarbon group having from about 8 to 32 carbon atoms but preferably from 8 to 22 carbon atoms and X is an alkali metal or ammonium. It is preferred if R in the above formula is higher aliphatic such as higher alkyl. A preferred compound in which R is higher aliphatic is sodium lauryl sulfate. It should be noted that sodium lauryl sulfate actually is a mixture of fatty alcohols derived from coconut oil, the fatty alcohols ranging from 8 carbon atoms to 18 carbon atoms, with lauryl alcohol being the most abundant component (about 49%). Other aliphatic sulfates useful in the present invention are sodium cetyl sulfate, sodium oleyl sulfate and sodium stearyl sulfate. Additionally, those sulfates derived from fish oils are useful in the present invention.

Exemplary of other water-soluble dispersents which are useful herein are the water-soluble salts of leonardite. Leonardite is a naturally occurring mineral (for example, found in North Dakota) and is sometimes considered a naturally oxidized lignite and contains humic acid. A water-soluble salt of leonardite may be made by reacting the leonardite with an alkali compound, e.g. sodium hydroxide, to form the corresponding salt, e.g. the sodium salt of sodium hydroxide is used. Other useful water-soluble salts of leonardite are the alkali metals such as sodium potassium, and lithium as well as the ammonia salts of leonardite. It should be emphasized however that the foregoing salts are merely exemplary and that any water-soluble salts of leonardite is useful in the present invention.

The preferred water-soluble polymer of the present invention is polyacrylic acid. As is known in the art, the salts of polyacrylic acid can be polymerized directly from the salts of acrylic acid. If desired, the salt of polyacrylic acid can be acidified to give polyacrylic acid. In this invention, polyacrylic acid can be utilized per se or, preferably, the water-soluble salts thereof.

Other water-soluble polymers which may be utilized in the present invention are hydrolyzed polyacrylonitrile, polyvinyl acetate, and polyvinyl alcohol. Additionally, copolymers of the foregoing can also be utilized and, preferably copolymers of polyacrylic acid and polyacrylonitrile, polyvinyl acetate, or polyvinyl alcohol. Moreover, another preferred copolymer is the copolymer of acrylic acid and maleic anhydride.

It is preferred if the above polymers have a molecular weight of at least about 100,000 and preferably 150,000 or more. The preferred molecular weight is between 500,000 and 2,000,000 or more.

The amount of water-soluble polymer utilized in the soil sealant composition of the present invention may range from 0.1% to 3.0%, by weight with the preferred range being from, say, 0.5% to 2 or 3%, by weight. The weight ratio of water-soluble dispersent to water-soluble polymer is preferably from 6:1–36.

The soil sealant composition is made very easily by merely dry mixing the bentonite, the water-soluble polymer, and the water-soluble dispersent to form a dry, granular or powder like composition. This dry composition can be easily introduced into the soil by mixing therewith.

In order to show the unexpected results of the compositions and method of this invention a silica sand was utilized having a 30% voids and to the silica sand was added 4.4 pounds of untreated bentonite per square foot of sand having a two-inch depth. An identical sand sample was taken and to this sand was added 4.4 pounds of the soil sealant composition of this invention per square foot of sand having a two-inch depth. The soil sealant composition has the following composition: 99%, by weight, of sodium bentonite, 0.5%, by weight, of sodium polyacrylate, and 0.5%, by weight, of sodium acid pyrophosphate.

Both samples of sand were prehydrated with 12 inches of tap water for 24 hours. Thereafter, a 10% sodium chloride aqueous solution was introduced into each and permeability measurements were made. The results were as follows:

| Time | Untreated Bentonite | Treated Bentonite |
|---|---|---|
| 0 | $5.0 \times 10^{-6}$ | $5.0 \times 10^{-6}$ |
| 96 hours | $9.2 \times 10^{-6}$ | $4.8 \times 10^{-6}$ |
| 120 hours | $5.0 \times 10^{-5}$ | $4.1 \times 10^{-6}$ |
| 144 hours | $5.0 \times 10^{-5}$ | $4.1 \times 10^{-6}$ |
| 168 hours | $5.1 \times 10^{-5}$ | $4.0 \times 10^{-6}$ |

Premeabilities are measured as centimeters per second per foot of head. It is noted that after 168 hours the treated material permitted only $10^{-6}$ centimeters per second whereas the untreated permitted $10^{-5}$ centimeters per second leakage, which indicates the treated material was 10 times superior.

In place of the sodium polyacrylate utilized in the above example, there could also be utilized any of the polymers of acrylic acid with vinyl acetate, vinyl alcohol, or maleic anhydride. Additionally, hydrolyzed polyacrylonitrile can be utilized to very good effect.

The particular amount of soil sealant composition added to the soil is not critical and good results have been attained utilized anywhere from 1 to 2 pounds per cubic foot of soil to upwards as high as 10 to 20 and even 40 or 60 pounds per cubic foot of soil, depending upon the porosity of the soil.

In the foregoing exemplary embodiment certain compounds and polymers were utilized and certain percentages; however, other polymers, dispersents and soil can be utilized to equally good effect and in varying amounts, it being understood that the exemplary embodiment is for illustration purposes only and is not to be considered limiting.

I claim:

1. A method for containing water having dissolved there water-soluble industrial waste salts which comprises:

dry mixing soil and a soil sealant composition consisting essentially of (A) bentonite; (B) a water-soluble soluble dispersing agent selected from the group consisting of a water-soluble salt of phosphoric acid, a water-soluble sulfate of the formula $ROSO_3X$ where R is hydrocarbon of from 8 to 32 carbon atoms and X is a member selected from the group consisting of an alkaline metal or ammonium, and a water-soulble salt of leonardite; and (C) a water-soluble polymer selected from the group consisting of polyacrylic acid, water-soluble salts of polyacrylic acid, hydrolyzed poly-acrylonitrile, polyvinyl acetate, polyvinyl alcohol, copolymers of the foregoing, and a copolymer of acrylic acid and maleic anhydride, the amount of water-soluble polymer in said soil sealant composition being from 0.1% to 3.0%, by weight, and the amount of water-soluble dispersent in said soil sealant composition being from 0.1% to 3.0%, by weight, the weight ratio of water-soluble dispersent to water-soluble polymer being from 6:1–36;

forming a water-containing enclosure from said mixture of said sealant composition and soil;

contacting said enclosure with water-containing substantially no water-soluble industrial waste salts thereby hydrating the bentonite;

and contacting said enclosure with the water contaminated with water-soluble industrial waste salts.

2. a method according to claim 1 wherein the water-soluble polymer is polyacrylic acid.

3. A method according to claim wherein the water-soluble polymer is a water-soluble salt of polyacrylic acid.

4. A method according to claim 1 wherein the water-soluble dispersing agent is a water-soluble salt of phosphoric acid.

5. A method according to claim 4 wherein the water-soluble salt of phosphoric acid is an alkaline metal pyrophosphate.

6. A method according to claim 5 wherein the alkaline metal pyrophosphate is sodium pyrophosphate.

7. A method according to claim 1 wherein R is hydrocarbon of from 8 to 22 carbon atoms and X is sodium.

8. A method according to claim 1 wherein the water-soluble dispersing agent is sodium lauryl sulfate.

9. A method according to claim 1 wherein the water-soluble dispersing agent is a water-soluble salt of leonardite.

10. A method according to claim 1 wherein the water-soluble dispersing agent is sodium leonardite.

* * * * *